US007697875B2

(12) United States Patent
Sakagawa et al.

(10) Patent No.: US 7,697,875 B2
(45) Date of Patent: Apr. 13, 2010

(54) DEVELOPMENT DEVICE FOR DEVELOPING AN ELECTROSTATIC LATENT IMAGE FORMED ON AN IMAGE CARRYING MEMBER INTO A VISIBLE IMAGE

(75) Inventors: Yoshio Sakagawa, Ashiya (JP); Yoshiko Ogawa, Toyonaka (JP)

(73) Assignee: Ricoh Company Limited, Tokyo (JP)

( * ) Notice: Subject to any disclaimer, the term of this patent is extended or adjusted under 35 U.S.C. 154(b) by 2 days.

(21) Appl. No.: 12/141,464

(22) Filed: Jun. 18, 2008

(65) Prior Publication Data

US 2008/0317513 A1 Dec. 25, 2008

(30) Foreign Application Priority Data

Jun. 22, 2007 (JP) ..... 2007-165502

(51) Int. Cl.
*G03G 15/08* (2006.01)

(52) U.S. Cl. ..... 399/281

(58) Field of Classification Search ..... 399/119, 399/281

See application file for complete search history.

(56) References Cited

U.S. PATENT DOCUMENTS

2006/0280529 A1 12/2006 Nakagawa et al.
2008/0056745 A1 3/2008 Fujita et al.
2008/0069592 A1 3/2008 Fujita et al.
2008/0075480 A1 3/2008 Konishi et al.

FOREIGN PATENT DOCUMENTS

JP 08314278 A * 11/1996
JP 9-311544 12/1997
JP 2004-4380 1/2004

OTHER PUBLICATIONS

Machine English Translation of JP08314278.*

* cited by examiner

*Primary Examiner*—David M Gray
*Assistant Examiner*—Billy J Lactaoen
(74) *Attorney, Agent, or Firm*—Oblon, Spivak, McClelland, Maier & Neustadt, L.L.P.

(57) ABSTRACT

An image forming apparatus includes either one of a process cartridge and a development device. The process cartridge is attachable to and detachable from the image forming apparatus, and integrally includes the development device. The development device includes a developer supplying member and a developer carrying member, at least one of which is formed of an elastic material, and which rotate in contact with each other. The developer supplying member is provided to be displacable in directions of contacting with and separating from the developer carrying member, and is biased toward the developer carrying member by predetermined biasing force.

20 Claims, 8 Drawing Sheets

DEVELOPMENT DEVICE FOR DEVELOPING AN ELECTROSTATIC LATENT IMAGE FORMED ON AN IMAGE CARRYING MEMBER INTO A VISIBLE IMAGE

CROSS-REFERENCE TO RELATED APPLICATIONS

This application claims priority to Japanese Patent Application No. 2007-165502 filed on Jun. 22, 2007, the entire contents of which are hereby incorporated by reference herein.

BACKGROUND OF THE INVENTION

1. Field of the Invention

The present invention relates to a development device for developing an electrostatic latent image formed on an image carrying member into a visible image, a process cartridge incorporating the development device, and an image forming apparatus, such as a multifunctional machine including at least one of a copier, a printer, a facsimile machine, and a plotter, which includes either one of the development device and the process cartridge.

2. Discussion of the Background Art

The above type of the development device is configured, for example, such that a development roller functioning as a developer carrying member and a supply roller functioning as a developer supplying member are rotated in contact with each other to supply a one-component developer stored in a development casing from the supply roller to the development roller. The developer supplied onto the development roller is spread into a thin layer and adhered to an electrostatic latent image formed on a photoconductor by an electric field generated by a developing bias voltage. The development roller and the supply roller are in contact with each other, with the rotary shaft of each of the rollers set to a predetermined position.

When the supply roller is brought into contact with the development roller, both the supply roller and the development roller compress, that is, deform due to the contact. The amount of such compression varies depending on such factors as the distance separating the shafts of the supply roller and the development roller and the outer diameters of the supply roller or the development roller. As a result, the force of contact between the rollers fluctuates, and an undesirable phenomenon such as an increase in motor torque occurs. That is, excessive pressure contact between the rollers causes the increase in torque and can result in motor failure, while insufficient pressure contact causes insufficient toner supply and a resultant decrease in image density, i.e., poor image quality.

To overcome the above-described problem by providing reliably stable contact between the rollers, the manufacturing precision of the rollers needs to be improved in terms of the shapes and the materials used, and techniques and skills to improve assembly precision are required.

SUMMARY OF THE INVENTION

This patent specification describes an image forming apparatus. In one example, an image forming apparatus includes either one of a process cartridge and a development device. The process cartridge is attachable to and detachable from the image forming apparatus, and integrally includes the development device. The development device includes a developer supplying member and a developer carrying member, at least one of which is formed of an elastic material, and which rotate in contact with each other. The developer supplying member is provided to be displaceable in directions of contacting with and separating from the developer carrying member, and is biased toward the developer carrying member by predetermined biasing force.

This patent specification further describes a process cartridge. In one example, a process cartridge is attachable to and detachable from an image forming apparatus, and integrally includes a development device. The development device includes a developer supplying member and a developer carrying member, at least one of which is formed of an elastic material, and which rotate in contact with each other. The developer supplying member is provided to be displacable in directions of contacting with and separating from the developer carrying member, and is biased toward the developer carrying member by predetermined biasing force.

This patent specification further describes a development device. In one example, a development device includes a developer supplying member and a developer carrying member, at least one of which is formed of an elastic material, and which rotate in contact with each other. The developer supplying member is provided to be displacable in directions of contacting with and separating from the developer carrying member, and is biased toward the developer carrying member by predetermined biasing force.

BRIEF DESCRIPTION OF THE DRAWINGS

A more complete appreciation of the invention and many of the advantages thereof are obtained as the same becomes better understood by reference to the following detailed description when considered in connection with the accompanying drawings, wherein.

DETAILED DESCRIPTION OF THE INVENTION

Figure 1:
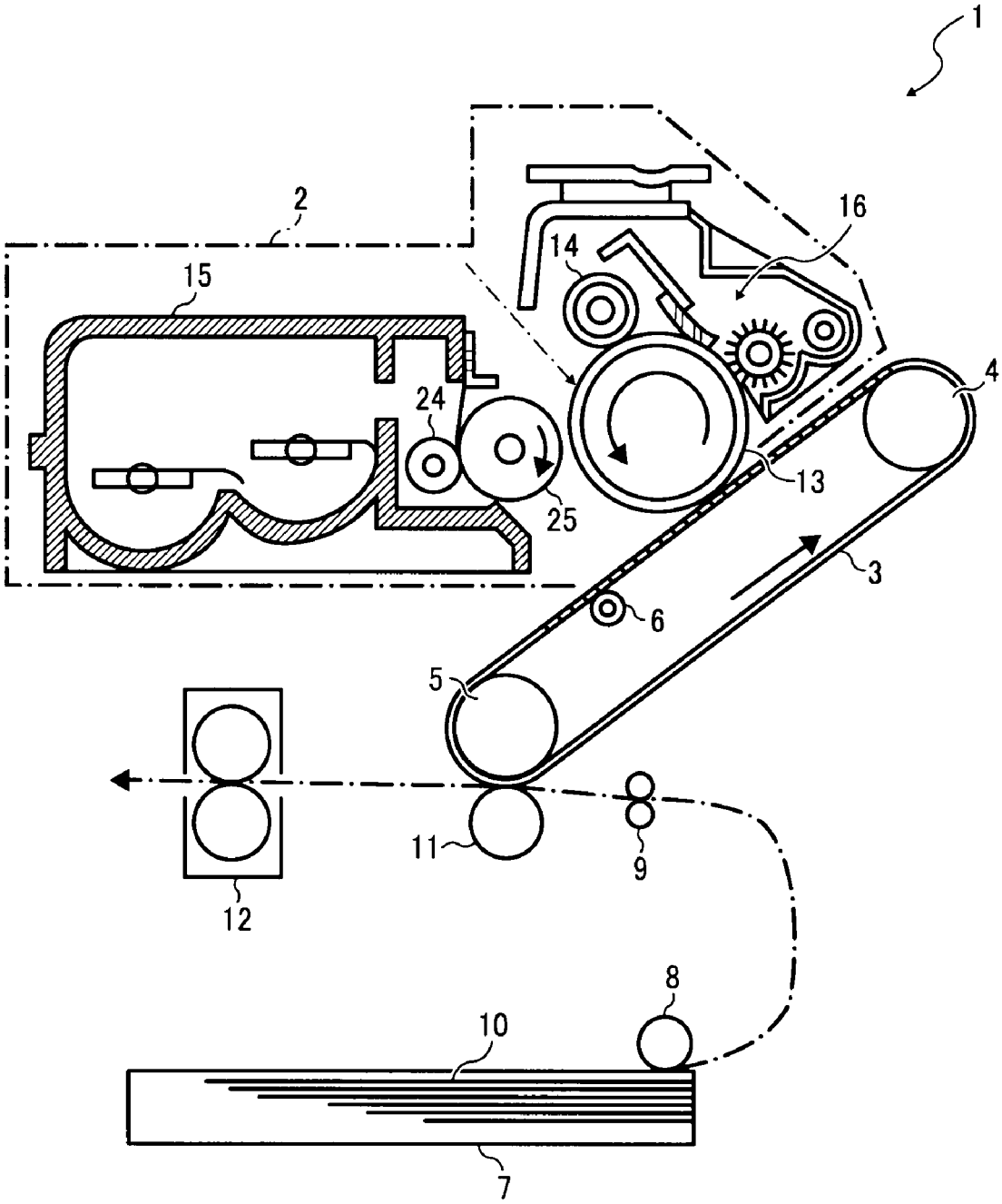
FIG. 1 is a schematic configuration diagram of an image forming apparatus according to a first embodiment of the present invention.

In describing the embodiments illustrated in the drawings, specific terminology is employed for the purpose of clarity. However, the disclosure of this patent specification is not intended to be limited to the specific terminology so used, and it is to be understood that substitutions for each specific element can include any technical equivalents that operate in a similar manner.

Referring now to the drawings, wherein like reference numerals designate identical or corresponding parts throughout the several views, particularly to FIGS. 1 to 7, description will be made of a first embodiment of the present invention.

As illustrated in FIG. 1, an image forming apparatus 1 according to the present embodiment includes a process cartridge 2 attachable to and detachable from the body of the image forming apparatus 1, an intermediate transfer belt 3, and so forth. The intermediate transfer belt 3 is stretched over support rollers 4 and 5.

A toner image formed on a photoconductor drum 13 included in the process cartridge 2 is electrostatically transferred onto the intermediate transfer belt 3 by a transfer bias voltage applied to a first transfer roller 6. Then, due to a transfer bias voltage applied to a second transfer roller 11, the transferred toner image is electrostatically transferred onto a recording medium 10 fed by a sheet-feeding roller 8 from a sheet-feeding cassette 7 and conveyed by a registration roller pair 9 at a predetermined timing. The recording medium 10 on which the toner image has been transferred is conveyed to a fixing device 12, in which the toner image is fixed on the recording medium 10 by heat and pressure applied thereon. The recording medium 10 subjected to the fixing process is discharged and stacked on a sheet-discharging tray (not illustrated).

Figure 2:
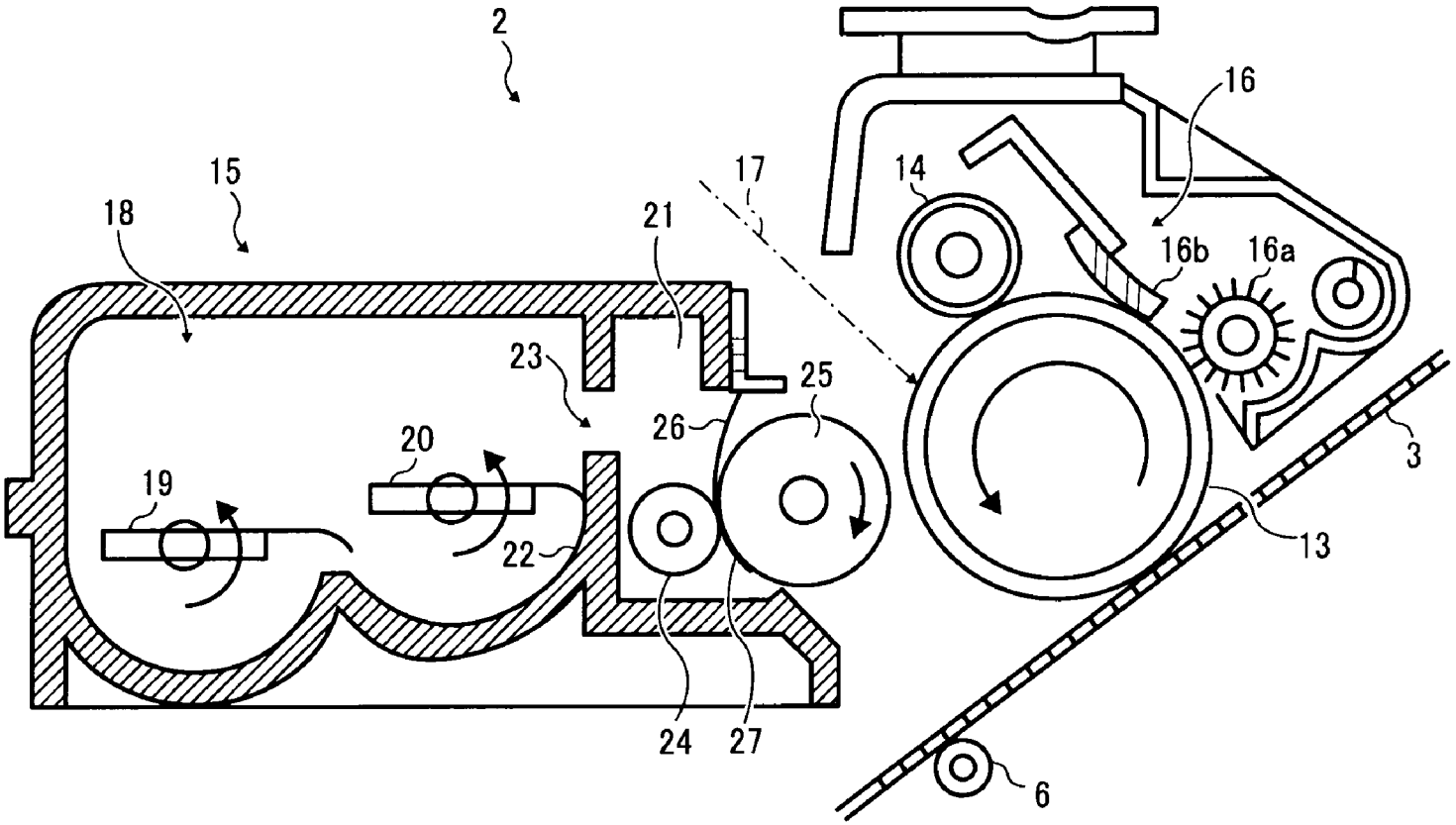
FIG. 2 is an enlarged view of a process cartridge included in the image forming apparatus.

On the basis of FIG. 2, detailed description will be made of the process cartridge 2 functioning as an image forming unit. The process cartridge 2 integrally includes the photoconductor drum 13 functioning as an image carrying member, a charging roller 14 functioning as a charging device for uniformly charging a surface of the photoconductor drum 13, a development device 15, a cleaning device 16, and so forth. The cleaning device 16 includes a cleaning brush 16*a*, a cleaning blade 16*b*, and so forth. The development device 15 includes a toner storage chamber 18, toner conveyance members 19 and 20, a toner supply chamber 21, a dividing wall 22, an opening 23, a supply roller 24, a development roller 25, a layer control member 26, and an entrance seal 27.

The uniformly charged surface of the photoconductor drum 13 is applied with an exposure beam 17 by an optical writing device (not illustrated) on the basis of target image data. Thereby, an electrostatic latent image is formed.

In the development device 15, the toner conveyance members 19 and 20 provided inside the toner storage chamber 18 rotate in the counterclockwise direction to send toner stored in the toner storage chamber 18 to the toner supply chamber 21. The dividing wall 22 provided between the toner storage chamber 18 and the toner supply chamber 21 is formed with the opening 23. Through the operation of the toner conveyance members 19 and 20, the toner is moved to the toner supply chamber 21 through the opening 23.

The supply roller 24 functioning as a developer supplying member is applied with a supply bias voltage having a value offset with respect to a developing bias voltage in the same direction as the direction of the charge polarity of the toner. The supply roller 24 is structured such that at least a surface layer thereof is formed of an elastic material.

The supply roller 24 provided inside the toner supply chamber 21 is disposed to be in contact (i.e., pressure contact) with the development roller 25 functioning as a developer carrying member by predetermined constant force. In this case, if at least either one of the supply roller 24 and the development roller 25 is formed of an elastic material, the two rollers come in contact with each other without difficulty. If the development roller 25 is formed of an inelastic material, however, it is necessary to use an elastic material as the later-described layer control member 26, and to keep the photoconductor drum 13 at a position not in contact with the intermediate transfer belt 3 or the development roller 25.

The supply bias voltage acts in a direction in which the pre-charged toner is pressed onto the development roller 25 at a portion of the supply roller 24 in contact with the development roller 25. The supply roller 24 rotates to supply the toner adhered to a surface thereof to a surface of the development roller 25 so that the surface of the development roller 25 is coated with the toner.

The development roller 25 is applied with the developing bias voltage to form an electric field between the development roller 25 and the photoconductor drum 13. The development roller 25 rotates in the clockwise direction to convey the toner carried on the surface thereof to the layer control member 26 and then to a position facing the photoconductor drum 13. The layer control member 26 is provided at a position higher than the position at which the supply roller 24 and the development roller 25 come in contact with each other.

The layer control member 26 has a free end made in contact with the surface of the development roller 25 by pressing force of approximately 10 N/m (newtons per meter) to approximately 40 N/m. The toner applied with the pressing force is spread into a thin layer and charged by frictional charging by the layer control member 26. To promote the frictional charging, the layer control member 26 is applied with a control bias voltage having a value offset with respect to the developing bias in the same direction as the direction of the charge polarity of the toner.

The photoconductor drum 13 rotates in the counterclockwise direction. Therefore, the surface of the development roller 25 moves in the same direction as the moving direction of the photoconductor drum 13 at the position facing the photoconductor drum 13. Along with the rotation of the development roller 25, the toner spread into the thin layer is conveyed to the position facing the photoconductor drum 13. Then, in accordance with a latent image electric field generated by the developing bias voltage applied to the development roller 25 and the electrostatic latent image formed on the photoconductor drum 13, the toner is moved to the surface of the photoconductor drum 13 and subjected to the development process. At an area through which the toner not having been transferred onto the photoconductor drum 13 for the development process and thus remaining on the development roller 25 returns into the toner supply chamber 21, the entrance seal 27 is provided in contact with the development roller 25 to seal the area for preventing the toner from leaking outside the development device 15.

In the above, excessive pressure contact of the supply roller 24 with the development roller 25 causes an increase in torque and a resultant motor failure. Meanwhile, insufficient pressure contact causes insufficient toner supply and insufficient force for scraping off the toner remaining on the development roller 25, and thus results in a decrease in image density.

Figure 3:
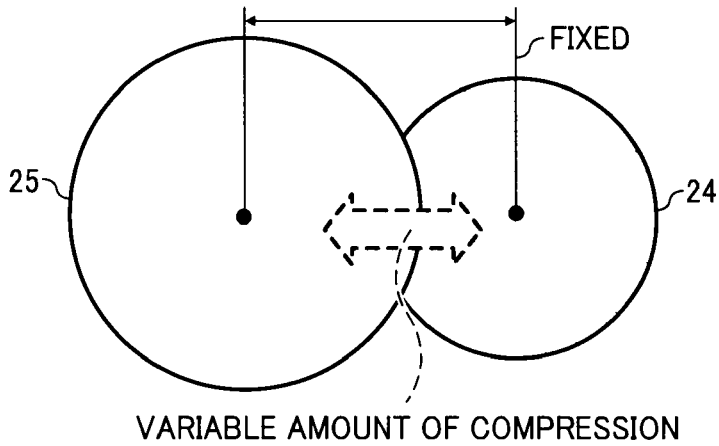
FIG. 3 is a schematic diagram illustrating a fixed-position configuration of a supply roller in a comparative example.
Figure 4:
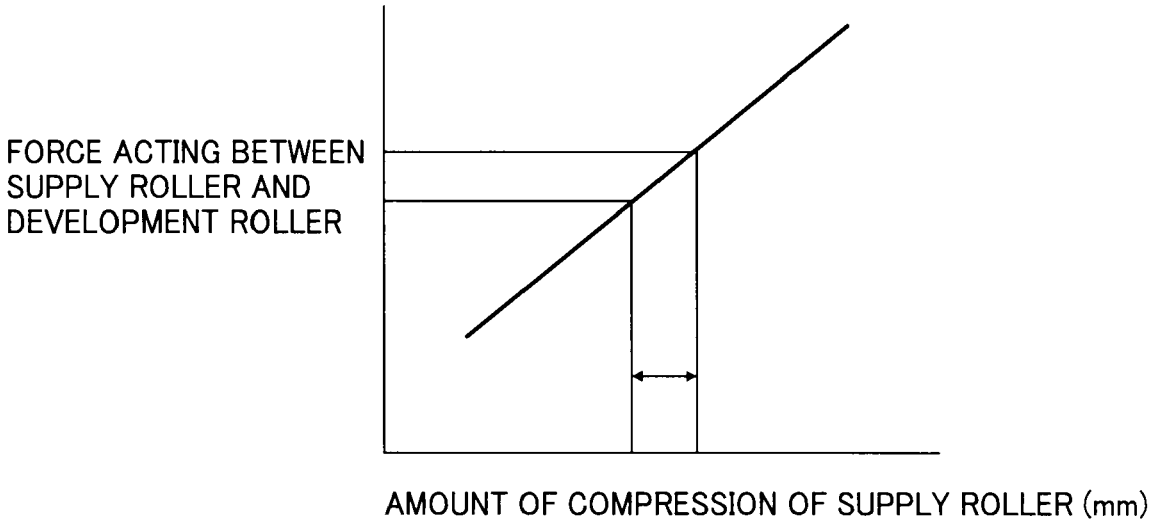
FIG. 4 is a graph illustrating the relationship between the amount of compression of the supply roller and the pressure contact between the supply roller and a development roller in the comparative example.

As illustrated in a comparative example of FIG. 3, if the position of the supply roller 24 (i.e., the position of the rotary shaft of the roller) is fixed, and if there is a variation in the distance between the rotary shafts of the supply roller 24 and the development roller 25 or in the outer diameter of one of the supply roller 24 and the development roller 25, the amount of compression of the elastic portion of the supply roller 24, i.e., the amount of elastic deformation of the supply roller 24 is changed. As a result, the pressure contact force acting between the supply roller 24 and the development roller 25 varies, as illustrated in FIG. 4.

Figure 5:
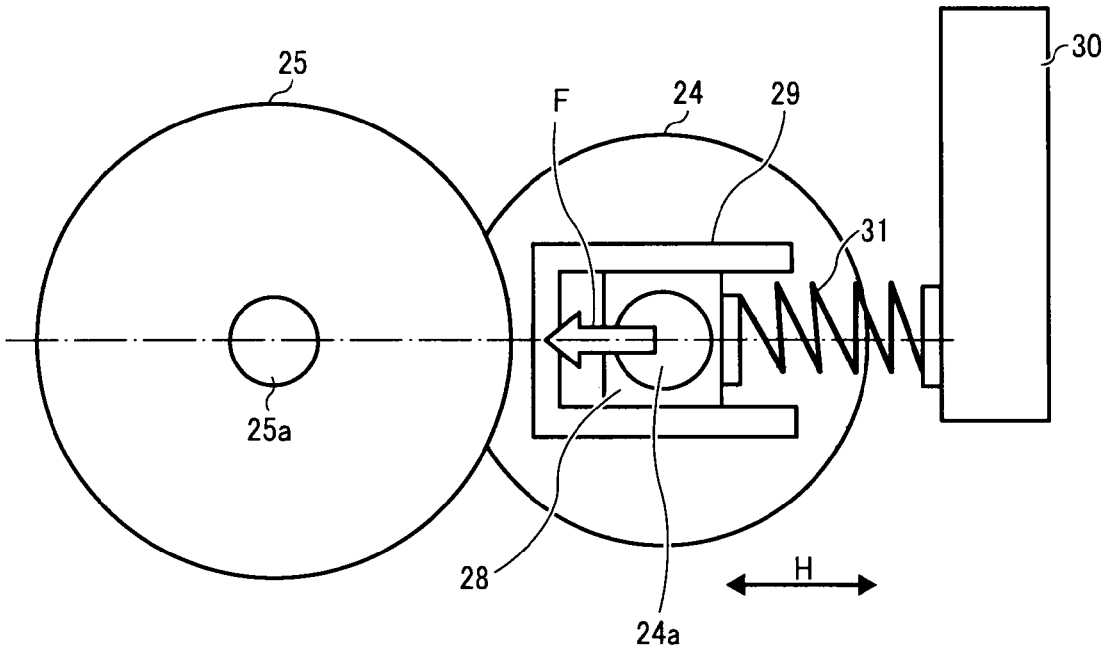
FIG. 5 is a diagram illustrating a configuration for biasing the supply roller to the development roller in the first embodiment of the present invention.

In view of the above, as illustrated in FIG. 5, the present embodiment is configured such that the position of the supply roller 24 can be displaced in directions of contacting with and separating from the development roller 25, i.e., in the directions indicated by arrows H, and that the supply roller 24 is biased. Meanwhile, the position of a rotary shaft of 25*a* of the development roller 25 is fixed.

Specifically, an end portion of a rotary shaft 24*a* of the supply roller 24 is attached with a bearing 28 which slidingly moves on a guide surface of a guide member 29 fixed to a development device body (not illustrated). Between the bearing 28 and a fixed member 30 of the development device body, a spring 31 functioning as a biasing member is provided to bias the supply roller 24 toward the development roller 25 with predetermined force F. The spring 31 is displaced in a direction intersecting the rotation center of the supply roller 24. The rotary shaft 25*a* of the development roller 25 is provided with a drive gear (not illustrated) for receiving driving force from a drive source (not illustrated). Meanwhile, the supply roller 24 is driven and rotated by friction.

Figure 6:
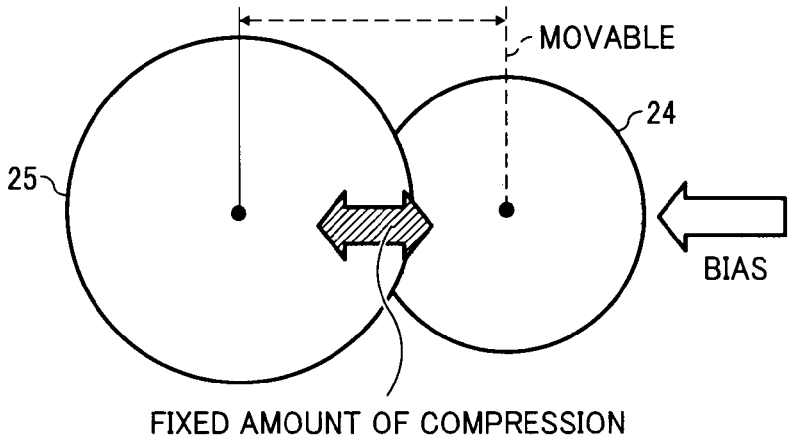
FIG. 6 is a schematic diagram illustrating a movable configuration of the supply roller in the first embodiment of the present invention.

With the supply roller 24 configured to be capable of being displaced in the above-described manner, if the amount of compression is likely to be increased due to the aforementioned variation, the position of the supply roller 24 is separated from the development roller 25 to release the pressure contact force acting between the supply roller 24 and the development roller 25, as illustrated in FIG. 6. As a result, the pressure contact force is reduced.

Figure 7:
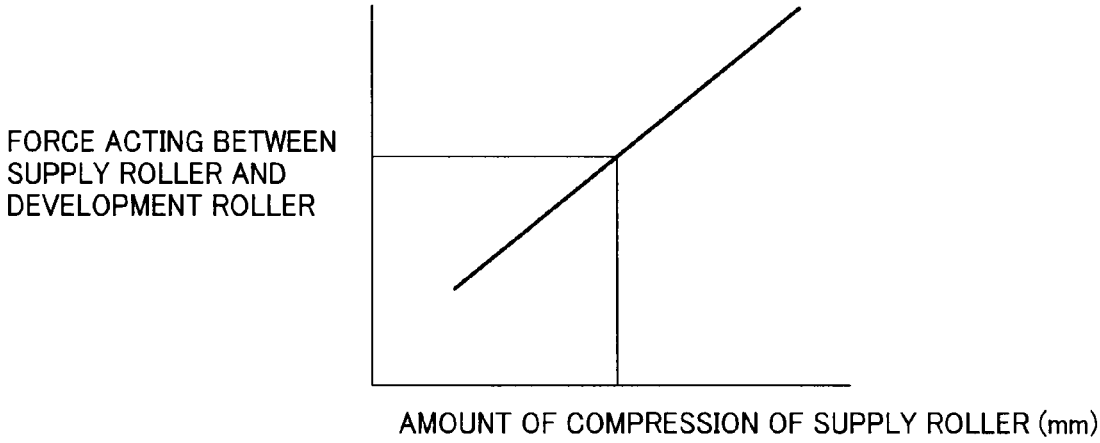
FIG. 7 is a graph illustrating the relationship between the amount of compression of the supply roller and the pressure contact between the supply roller and the development roller in the first embodiment of the present invention.

Meanwhile, if the amount of compression is likely to be reduced, the biased supply roller 24 approaches the development roller 25 to increase the pressure contact force. Therefore, the pressure contact force is controlled by the force biasing the supply roller 24, and is kept constant, as illustrated in FIG. 7.

Accordingly, stable quality can be obtained irrespective of a change in the distance between the supply roller 24 and the development roller 25 or in the outer diameter of one of the supply roller 24 and the development roller 25. The above-described configuration allows a certain amount of variation in the manufacturing accuracy and the assembly accuracy of the supply roller 24 and the development roller 25. Accordingly, the configuration simplifies the manufacture and assembly of the rollers, and thus can contribute to the improvement of the productivity and the reduction in production cost and provide uniform image quality.

As described above, at least the surface layer of the supply roller 24 is formed of an elastic material. Thus, the developer is conveyed by the frictional force of the surface of the supply roller 24 and supplied to the development roller 25. Accordingly, the performance of supplying the developer is improved, and a sufficient image density is ensured.

The pressure contact force acting between the supply roller 24 and the development roller 25 is preferably set within a range of from approximately 0.1 newtons to approximately 1.0 newtons. Table 1 provided below presents the result of an experiment. In the row of the image quality in Table 1, GOOD indicates that a memory of a residual image was not generated, while POOR indicates that the memory of a residual image was generated. Further, in the row of the motor performance, GOOD indicates that a motor failure did not occur, while POOR indicates that an abnormal stop of a motor occurred. As indicated in Table 1, if the value of the pressure contact force is lower than the above-described range, the force for scraping off the toner from the development roller 25 is reduced, and the memory of a residual image is generated. Meanwhile, if the value of the pressure contact force is higher than the range, the torque is increased. If the pressure contact force acting between the supply roller 24 and the development roller 25 is set within the optimal range, the force for scraping off the toner from the surface of the development roller 25 can be ensured. Accordingly, it is possible to suppress the generation of the memory of a residual image and the increase in the torque. Further, in the present embodiment, the supply roller 24 is biased by the spring 31. Therefore, the supply roller 24 can be pressed onto the development roller 25 by a simple configuration.

TABLE 1

| | Set Range of Pressure Contact Force | | | | | |
|---|---|---|---|---|---|---|
| | Pressure contact force (N) | | | | | |
| | 0.05 | 0.1 | 0.3 | 0.7 | 1 | 1.1 |
| Image quality | POOR | GOOD | GOOD | GOOD | GOOD | GOOD |
| Motor performance | GOOD | GOOD | GOOD | GOOD | GOOD | POOR |

Figure 8:
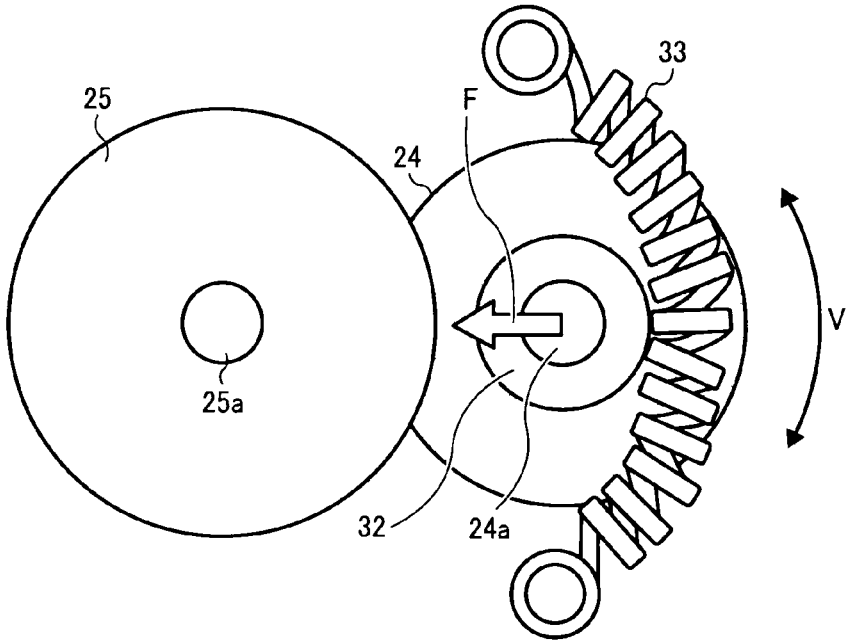
FIG. 8 is a diagram illustrating a configuration for biasing the supply roller according to a second embodiment of the present invention.

FIG. 8 illustrates a second embodiment of the present invention. In the drawing, the same components as the components of the first embodiment are designated by the same reference numerals. Further, only relevant parts will be described, with the description of the configurations and functions already described above omitted unless particularly necessary. The same applies to other embodiments described later.

In the second embodiment, a spring 33 is provided along the outer circumferential surface of a circular bearing 32 attached to the rotary shaft 24*a* of the supply roller 24. The opposite ends of the spring 33 are fixed to the development device body, and the spring 33 is displaced in the circumferential directions of the supply roller 24, i.e., the directions indicated by arrows V. Herein, the illustration of a configuration for guiding the rotary shaft 24*a* is omitted.

Figure 9:
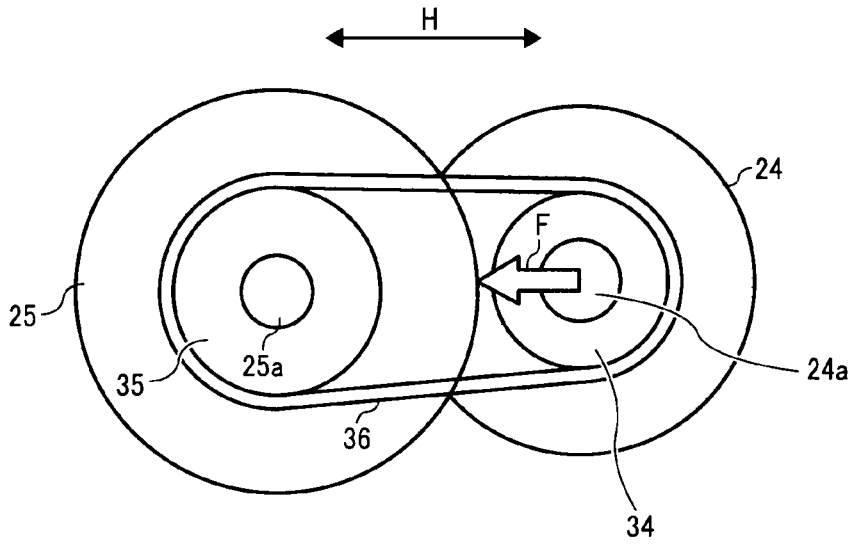
FIG. 9 is a diagram illustrating a configuration for biasing the supply roller according to a third embodiment of the present invention.

FIG. 9 illustrates a third embodiment of the present invention. In the present embodiment, the rotary shaft 24*a* of the supply roller 24 and the rotary shaft 25*a* of the development roller 25 are provided with a gear 34 and a gear 35, respectively. Further, a toothed belt 36 functioning as a loop-shaped elastic drive member is stretched over the gears 34 and 35. Thereby, the supply roller 24 is driven and rotated in synchronization with the development roller 25. The biasing force F is ensured due to the elasticity of the toothed belt 36, and the abovementioned variation is controlled by the displacement of the toothed belt 36 in the directions indicated by the arrows H. The toothed belt 36 functions both as the drive member and a biasing member. Accordingly, the driving operation and the biasing operation can be performed by the simple configuration. Herein, the illustration of a configuration for guiding the rotary shaft 24*a* is omitted.

Figure 10:
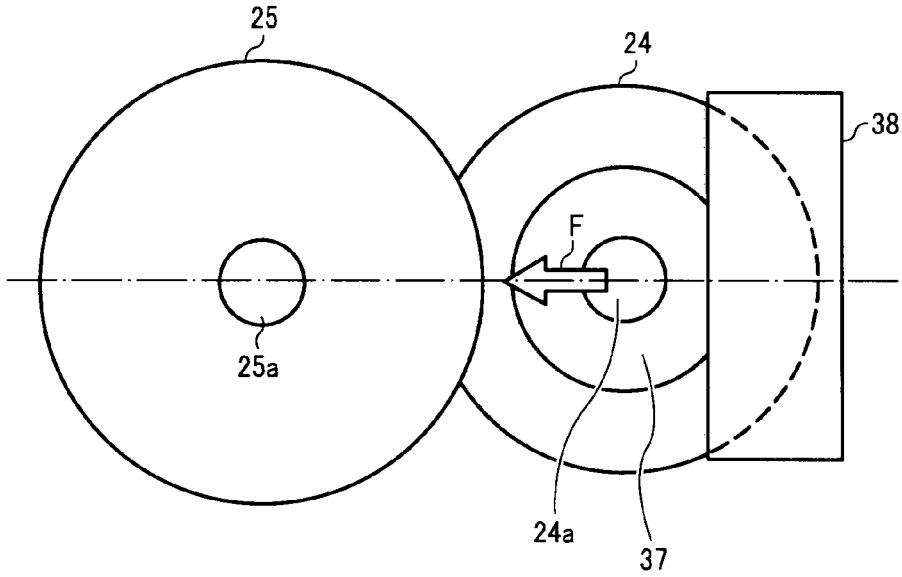
FIG. 10 is a diagram illustrating a configuration for biasing the supply roller according to a fourth embodiment of the present invention.

FIG. 10 illustrates a fourth embodiment of the present invention. In this type of the development device, to prevent toner leakage from an end portion of the supply roller 24, an end portion of the rotary shaft 24*a* of the supply roller 24 is provided with an elastic seal member. In the present embodiment, the elastic seal member is used as a biasing member. As illustrated in FIG. 10, an end portion of the rotary shaft 24*a* of the supply roller 24 is attached with an elastic seal member 37 for sealing purpose to prevent the toner leakage from the axial direction of the supply roller 24. The elastic seal member 37 is compressed and deformed by a fixed member 38 fixed to the development device body. Due to the deformation, the biasing force F is generated. The present embodiment uses an already existing member as the biasing member, and thus can simplify the configuration thereof. Herein, the illustration of a configuration for guiding the rotary shaft 24*a* is omitted.

Figure 11:
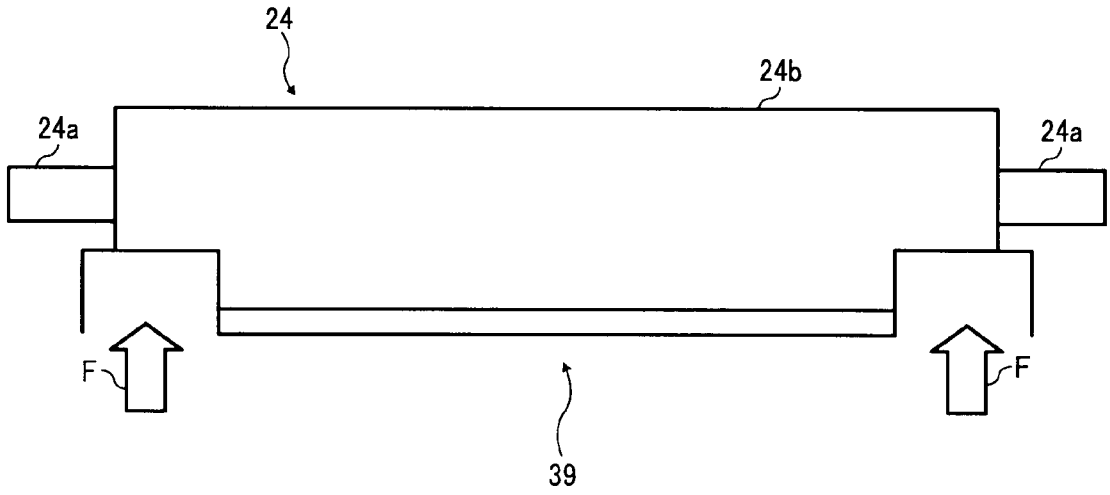
FIG. 11 is a diagram illustrating a configuration for biasing the supply roller according to a fifth embodiment of the present invention.

FIG. 11 illustrates a fifth embodiment of the present invention. In the present embodiment, a fixed member 39 fixed to the development device body is pressed onto the opposite end portions of an elastic roller body 24*b* of the supply roller 24. Due to the deformation of the roller body 24*b*, the biasing force F is generated. A contact surface of the fixed member 39 is formed into a shape corresponding to the outer circumferential surface of the roller body 24*b*. Further, the frictional force acting between the fixed member 39 and the roller body 24*b* is set to be smaller than the frictional force acting between the roller body 24*b* and the development roller 25. That is, the frictional force acting between the fixed member 39 and the roller body 24*b* is set to a level not hindering the frictional driven rotation of the supply roller 24 caused by the development roller 25. The present embodiment can obtain the biasing force F without preparing a separate biasing member, and thus can simplify the configuration thereof.

Figure 12:
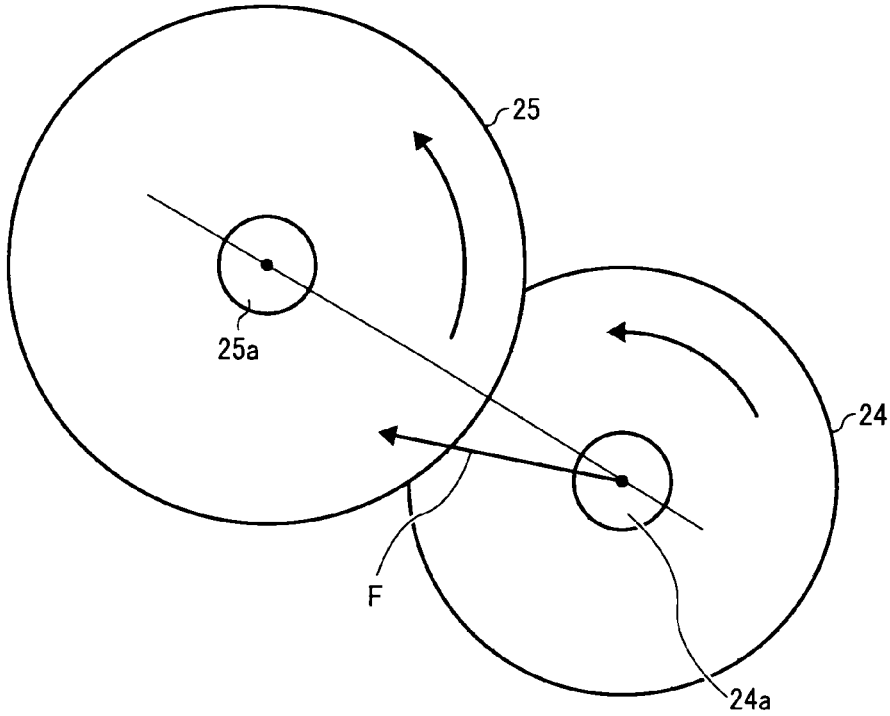
FIG. 12 is a diagram illustrating a direction of biasing the supply roller according to a sixth embodiment of the present invention.

FIG. 12 illustrates a sixth embodiment of the present invention. In the present embodiment, to mechanically scrape off the toner remaining on the development roller 25 with the use of the supply roller 24, the rotation direction of the supply roller 24 is set to be the same as the rotation direction of the development roller 25. With this configuration, the moving direction of the supply roller 24 and the moving direction of the development roller 25 become opposite to each other in the area in which the two rollers come in contact with each other. As a result, the effect of mechanically scraping off the toner is improved. To stabilize a nip portion formed in the contact area of the supply roller 24 and the development roller 25, and to suppress the increase in torque, it is effective to set the direction of biasing the supply roller 24 to be more downstream in the rotation direction of the supply roller 24 than a direction intersecting the rotation centers of the supply roller 24 and the development roller 25.

Figure 13:
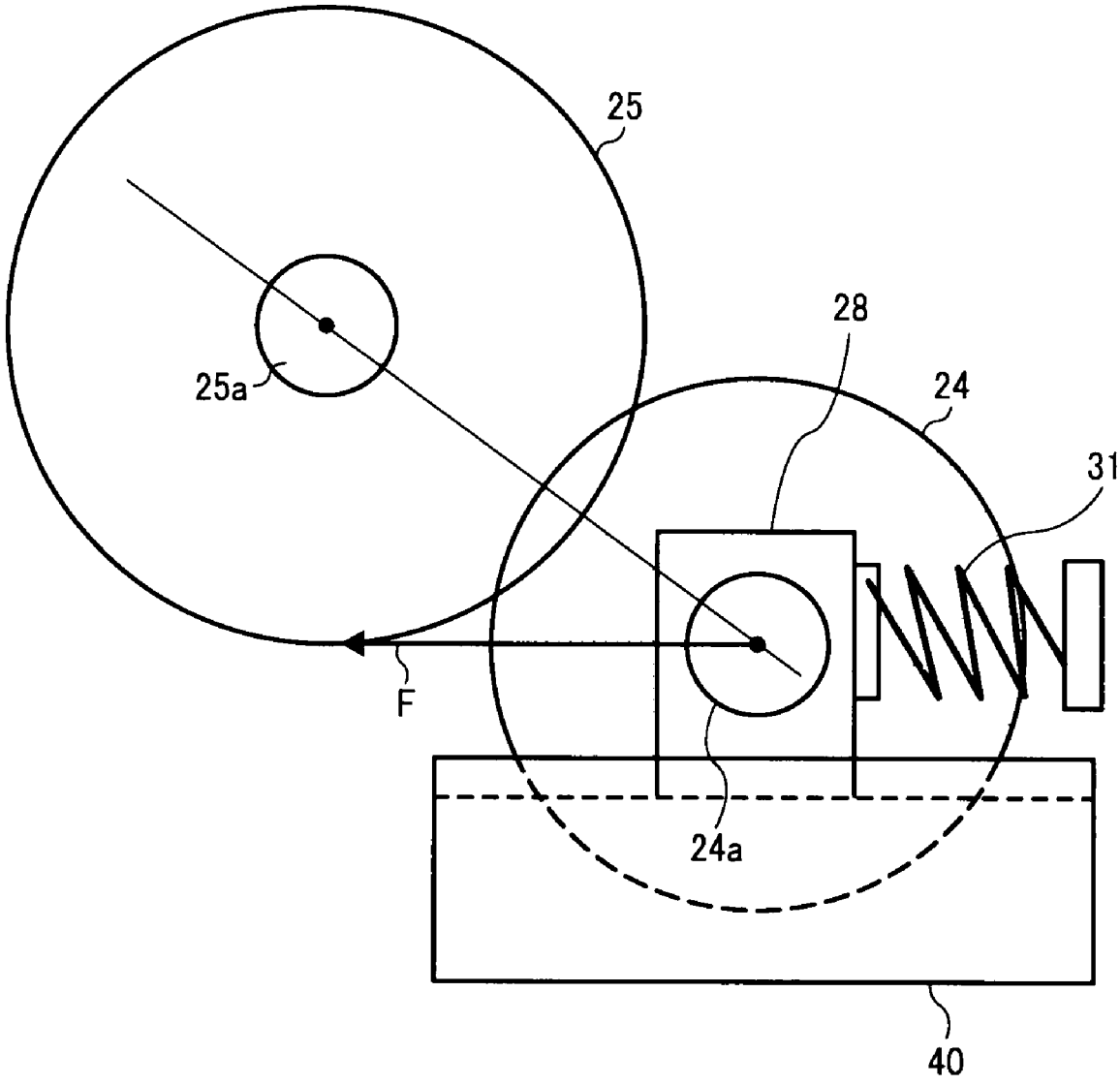
FIG. 13 is a diagram illustrating a configuration for biasing the supply roller according to a seventh embodiment of the present invention.

FIG. 13 illustrates a seventh embodiment of the present invention. The present embodiment aims to reliably obtain the biasing direction in the configuration in which the direction of biasing the supply roller 24 is set to be more downstream in the rotation direction of the supply roller 24 than the direction intersecting the rotation centers of the supply roller 24 and the development roller 25. The bearing 28 is engaged with a groove (not illustrated) of a fixed member 40 fixed to the development device body. With the bearing 28 guided by the fixed member 40 and moved by the biasing force of the spring 31, the biasing direction can be reliably obtained.

As an eight embodiment of the present invention, a contact development system may be employed in which the development roller 25 is formed of an elastic material and made in contact with the photoconductor drum 13 including an aluminum pipe to perform the development process. With this configuration, the present embodiment can improve the image quality.

In each of the above-described embodiments, the present invention is applied to a monochrome image forming apparatus, as an example. Alternatively, the present invention can similarly be implemented in a multicolor image forming apparatus and a tandem-type color image forming apparatus according to an intermediate transfer method or a direct transfer method.

The above-described embodiments are illustrative and do not limit the present invention. Thus, numerous additional modifications and variations are possible in light of the above teachings. For example, elements at least one of features of different illustrative and exemplary embodiments herein may be combined with each other at least one of substituted for each other within the scope of this disclosure and appended claims. Further, features of components of the embodiments, such as the number, the position, and the shape, are not limited the embodiments and thus may be preferably set. It is therefore to be understood that within the scope of the appended claims, the disclosure of this patent specification may be practiced otherwise than as specifically described herein.

The invention claimed is:

1. A development device, comprising:

a developer supplying member; and a developer carrying member which rotates in contact with the developer supplying member;

at least one of the developer supplying member and the developer carrying member being formed of an elastic material; and the developer supplying member being displaceable in directions of contacting with and separating from the developer carrying member, and biased toward the developer carrying member by a predetermined biasing force in a range of from approximately 0.1 newtons to approximately 1.0 newtons.

2. The development device as described in claim 1, wherein the developer supplying member is formed of an elastic material.

3. The development device as described in claim 2, further comprising:

a fixed member fixed to the development device to come in contact with and deform an elastic portion of the developer supplying member not in contact with the developer carrying member to generate the biasing force.

4. The development device as described in claim 2, wherein the developer carrying member is formed of an elastic material.

5. The development device as described in claim 1, further comprising a biasing member for performing either one of elastic deformation and elastic displacement to bias the developer supplying member toward the developer carrying member.

6. The development device as described in claim 5, wherein the biasing member is displaced in a direction intersecting an axis of rotation of the developer supplying member.

7. The development device as described in claim 5, wherein the biasing member is displaced in circumferential directions of the developer supplying member.

8. The development device as described in claim 1, further comprising:

a loop-shaped elastic drive member for coupling the developer supplying member to the developer carrying member.

9. The development device as described in claim 1, further comprising:

an elastic seal member provided to an end portion in the axial direction of the developer supplying member to seal a developer; and a fixed member fixed to the development device to come in contact with and deform the elastic seal member to generate the predetermined biasing force.

10. The development device as described in claim 1, wherein a rotation direction of the developer supplying member is the same as a rotation direction of the developer carrying member.

11. The development device as described in claim 10, wherein a direction of biasing the developer supplying member is downstream of a direction intersecting the axes of rotation of both the developer supplying member and the developer carrying member in the rotation direction of the developer supplying member.

12. The development device as described in claim 11, wherein the developer supplying member is moved along a portion of the development device.

13. A development device, comprising:

a developer supplying member;

a developer carrying member which rotates in contact with the developer supplying member;

at least one of the developer supplying member and the developer carrying member being formed of an elastic material;

the developer supplying member being displaceable in directions of contacting with and separating from the developer carrying member, and biased toward the developer carrying member by a predetermined biasing force; and a biasing member for performing either one of elastic deformation and elastic displacement to bias the developer supplying member toward the developer carrying member.

14. The development device as described in claim 13, wherein the predetermined biasing force for biasing the developer supplying member toward the developer carrying member is in a range of from approximately 0.1 newtons to approximately 1.0 newtons.

15. The development device as described in claim 13, wherein the biasing member is displaced in a direction intersecting an axis of rotation of the developer supplying member.

16. The development device as described in claim 13, wherein the biasing member is displaced in circumferential directions of the developer supplying member.

17. A development device, comprising:

a developer supplying member;

a developer carrying member which rotates in contact with the developer supplying member;

at least one of the developer supplying member and the developer carrying member being formed of an elastic material; and the developer supplying member being displaceable in directions of contacting with and separating from the developer carrying member, and biased toward the developer carrying member by a predetermined biasing force in a direction of biasing, wherein a rotation direction of the developer supplying member is the same as a rotation direction of the developer carrying member, and the direction of biasing the developer supplying member is downstream of a direction intersecting the axes of rotation of both the developer supplying member and the developer carrying member in the rotation direction of the developer supplying member.

18. The development device as described in claim 17, wherein the developer supplying member is moved along a portion of the development device.

19. The development device as described in claim 17, wherein the predetermined biasing force for biasing the developer supplying member toward the developer carrying member is in a range of from approximately 0.1 newtons to approximately 1.0 newtons.

20. The development device as described in claim 17, further comprising:

a biasing member for performing either one of elastic deformation and elastic displacement to bias the developer supplying member toward the developer carrying member.

* * * * *